US009074368B2

(12) United States Patent
Muska

(10) Patent No.: US 9,074,368 B2
(45) Date of Patent: Jul. 7, 2015

(54) ENERGY ABSORBING SYSTEM FOR SAFEGUARDING STRUCTURES FROM DISRUPTIVE FORCES

(71) Applicant: Martin A. Muska, Huntington Beach, CA (US)

(72) Inventor: Martin A. Muska, Huntington Beach, CA (US)

( * ) Notice: Subject to any disclaimer, the term of this patent is extended or adjusted under 35 U.S.C. 154(b) by 0 days.

(21) Appl. No.: 13/734,799

(22) Filed: Jan. 4, 2013

(65) Prior Publication Data

US 2014/0075857 A1 Mar. 20, 2014

Related U.S. Application Data

(63) Continuation of application No. 11/929,080, filed on Oct. 30, 2007, now Pat. No. 8,381,463.

(51) Int. Cl.

| | |
|---|---|
| ***E04B 1/98*** | (2006.01) |
| ***F16M 13/00*** | (2006.01) |
| ***F16F 7/12*** | (2006.01) |
| ***F16F 7/10*** | (2006.01) |
| ***F16F 9/30*** | (2006.01) |
| ***E04G 23/04*** | (2006.01) |
| *E04H 9/02* | (2006.01) |

(52) U.S. Cl.

CPC ..... *E04B 1/985* (2013.01); *E04H 9/022* (2013.01); *E04H 9/021* (2013.01); *E04G 23/04* (2013.01); *E04H 9/023* (2013.01)

(58) Field of Classification Search

CPC ... E04H 9/022; E04H 9/021; E04H 2009/026; E04H 9/02; E02D 31/08; F16F 1/373; F16F 13/105; F16F 1/374; F16F 2230/14; F16F 9/10; F16F 13/30; F16F 15/022; F16F 1/025; F16F 1/403; F16F 2230/105; F16F 3/0935; F16F 9/08; E01D 19/046; E01D 19/045; E04F 19/026; E04B 1/3211

USPC ..... 52/167.1, 167.2, 167.4, 167.6–167.9, 52/2.22, 2.23, 2.14, 2.17, 2.19, 2.13, 52/717.04, 718.01; 248/634, 560, 615, 248/345.1; 188/314, 371, 377, 378, 268; 267/164, 160, 116, 140.5, 136, 140.11, 267/113, 64.11; 404/6, 9–11; 256/1, 13.1; 254/89 H, 93 HP

See application file for complete search history.

(56) References Cited

U.S. PATENT DOCUMENTS

| | | | | | |
|---|---|---|---|---|---|
| 2,893,665 | A | * | 7/1959 | Paulsen | 248/615 |
| 3,473,836 | A | * | 10/1969 | Halter | 293/107 |
| 4,266,379 | A | * | 5/1981 | Valencia Aguilar | 52/1 |
| 4,362,424 | A | * | 12/1982 | Barber | 404/6 |
| 4,451,518 | A | * | 5/1984 | Miura et al. | 428/137 |
| 4,633,628 | A | * | 1/1987 | Mostaghel | 52/167.7 |

(Continued)

*Primary Examiner* — Phi A
*Assistant Examiner* — Omar Hijaz
(74) *Attorney, Agent, or Firm* — Jafari Law Group, Inc.; David V. Jafari; Saul Acherman

(57) ABSTRACT

The invention is an energy absorbing system for safeguarding structures from disruptive forces, which may be implemented into structures or devices to provide protection from seismic motion, blasts or other disruptive forces, due to the system's displacement and damping characteristics. The system's performance can be better molded analytically to predict performance of the structure under earthquake and wind motions, for example. By utilizing cost effective materials and a simple design, the present invention provides a more efficient cost-effective system for absorbing unwanted energy, for example, a base isolation system.

18 Claims, 6 Drawing Sheets

(56) References Cited

U.S. PATENT DOCUMENTS

| | | | | | |
|---|---|---|---|---|---|
| 4,761,925 | A * | 8/1988 | Fukahori et al. | ..... | 52/167.7 |
| 5,353,559 | A * | 10/1994 | Murota et al. | ..... | 52/167.1 |
| 5,884,440 | A * | 3/1999 | Kubo et al. | ..... | 52/167.1 |
| 6,126,136 | A * | 10/2000 | Yen et al. | ..... | 248/560 |
| 6,254,067 | B1 * | 7/2001 | Yih | ..... | 267/64.22 |
| 7,070,030 | B2 * | 7/2006 | Etcheverry | ..... | 188/371 |
| 7,517,001 | B1 * | 4/2009 | Goldbaum | ..... | 296/128 |
| 8,162,383 | B2 * | 4/2012 | Curtis | ..... | 296/180.4 |

* cited by examiner

ENERGY ABSORBING SYSTEM FOR SAFEGUARDING STRUCTURES FROM DISRUPTIVE FORCES

PRIORITY NOTICE

The present application is a continuation application, which claims priority under 35 U.S.C. §120 to U.S. patent application Ser. No. 11/929,080, filed on Oct. 30, 2007, the disclosure of which is incorporated herein by reference in its entirety.

TECHNICAL FIELD OF THE INVENTION

This invention relates generally to an energy absorbing system to safeguard structures from external disruptive forces, and more specifically a more reliable and cost effective base isolation system that has displacement damping characteristics, which may be utilized to protect structures, for example a building, by lessening motion transferred to the structures from sources such as earthquakes, strong winds, or explosive blasts.

BACKGROUND OF THE INVENTION

Traditionally, the conventional approach to protecting structures from disruptive forces, for example strong winds, seismic vibrations, or explosions, has been to strengthen structures themselves—either by fortifying a structure's walls and foundations, or simply by utilizing stronger, perhaps heavier materials. In the last few decades, those skilled in the art have understood that such methods are not appropriate for medium to tall structures due to the frequencies that are generated through, for example, buildings or bridges, which ultimately cause the structures to collapse. These old methods of strengthening structures are thus not as effective for any structure as newly developed methods.

Relatively recent, base isolation devices have been developed to isolate or decouple structures from disruptive forces, such as seismic forces produced during an earthquake, or strong winds, in particular against tall structures such as buildings. However, these systems have proven expensive and inadequate for smaller structures such as family homes.

In addition to the higher costs that make base isolation and similar devices inadequate for smaller, family homes (i.e. most contractors wont implement such devices in family homes to keep budgets low), current designs are difficult to predict mathematically, which poses a major problem for engineers that design structures that necessitate base isolation technology.

There is a need in the art for an energy absorbing system that may be implemented in a variety of applications, that is cost-effective, that can be constructed from known materials, is more reliable and less expensive to construct than devices presently known in the art, and a design that facilitates finite prediction modeling. It is to these ends that the present invention has been developed.

SUMMARY OF THE INVENTION

To minimize the limitations found in the prior art, and to minimize other limitations that will be apparent upon the reading of the specification, the present invention provides an energy absorbing system for safeguarding structures from disruptive forces.

An energy absorbing apparatus for protecting a structure from disruptive forces, in accordance with the present invention, comprises a base adapted to attach to a foundation of a structure, a cover coupled to said base in a manner to form an enclosure, wherein said cover is adapted to attach to said base and said structure, and an energy absorbing material situated within said enclosure.

A method of protecting a structure from a disruptive force, in accordance with the present invention, comprises forming an enclosure containing an energy absorbing material, coupling said enclosure to a base of a structure, and coupling said enclosure to said structure.

Finally, an energy absorbing structure, in accordance with the present invention, comprises a support member, a frame, and at least one energy absorbing apparatus. The energy absorbing apparatus further comprises a base adapted to attach to a support member of said structure, a cover coupled to said base in a manner to form an enclosure, wherein said cover is adapted to attach to said base and said structure, and an energy absorbing material situated within said enclosure.

Furthermore, the energy absorbing apparatus has enough flexibility to move perpendicular to the direction of said disruptive force, so that the stiffness of each device perpendicular to the direction of loading is minimal.

It is an object of the present invention to improve a retaining wall's ability to resist the surge of earth or ground pressures, for example seismic pressures.

It is another object of the present invention to improve a water barrier's or levee's ability to resist a surge of water.

It is yet another object of the present invention to provide the safe delivery and transportation of valuable cargo by improving containing structures.

It is yet another object of the present invention to protect statutes, artifacts, or other similar works of art by improving their stability.

It is yet another object of the present invention to minimize damage to goods in cargo dropped from the air, for example in applications for military, aid, or rescue operations.

It is yet another object of the present invention to provide a dynamic energy absorbing device that may be implemented in a variety of applications with few or no modifications.

It is yet another object of the present invention to provide an energy absorbing device that is cost-effective for use into family homes and smaller 1 to 4 story buildings.

Finally, it is another object of the present invention to provide a unique unidirectional device with minimal stiffness perpendicular to the direction of loading, which facilitates finite mathematical modeling.

These and other advantages and features of the present invention are described with specificity so as to make the present invention understandable to one of ordinary skill in the art.

BRIEF DESCRIPTION OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

FIG. 1(*b*) is a side view of an energy absorbing apparatus installed within a structure, for example between the floor and foundation of a building, in accordance with one embodiment of the present invention.

FIG. 1(*c*) is a close-up view of a lower right portion of the energy absorbing apparatus illustrated in FIG. 1(*b*), depicting an exemplary way to assemble the various components of one embodiment of an energy absorbing apparatus, and a desired notch or spacing to add flexibility and decrease stiffness, between the base of the apparatus and a support member of a structure, for example a foundation of a building, in accordance with an exemplary embodiment of the present invention.

FIG. 1(*d*) is a cross-sectional view of an energy absorbing apparatus depicted in FIG. 1(*b*)-(*c*), illustrating its internal composition.

FIG. 2(*b*) is an elevated plane view of a fully-assembled energy absorbing device in accordance with an exemplary embodiment of the present invention.

FIG. 4(*b*) is an illustration of one embodiment of a typical installation of energy absorbing apparatuses, which provides users with easy access to perform servicing or maintenance to such devices, for example, after an earthquake.

DETAILED DESCRIPTION OF THE DRAWINGS

Figure 1A:
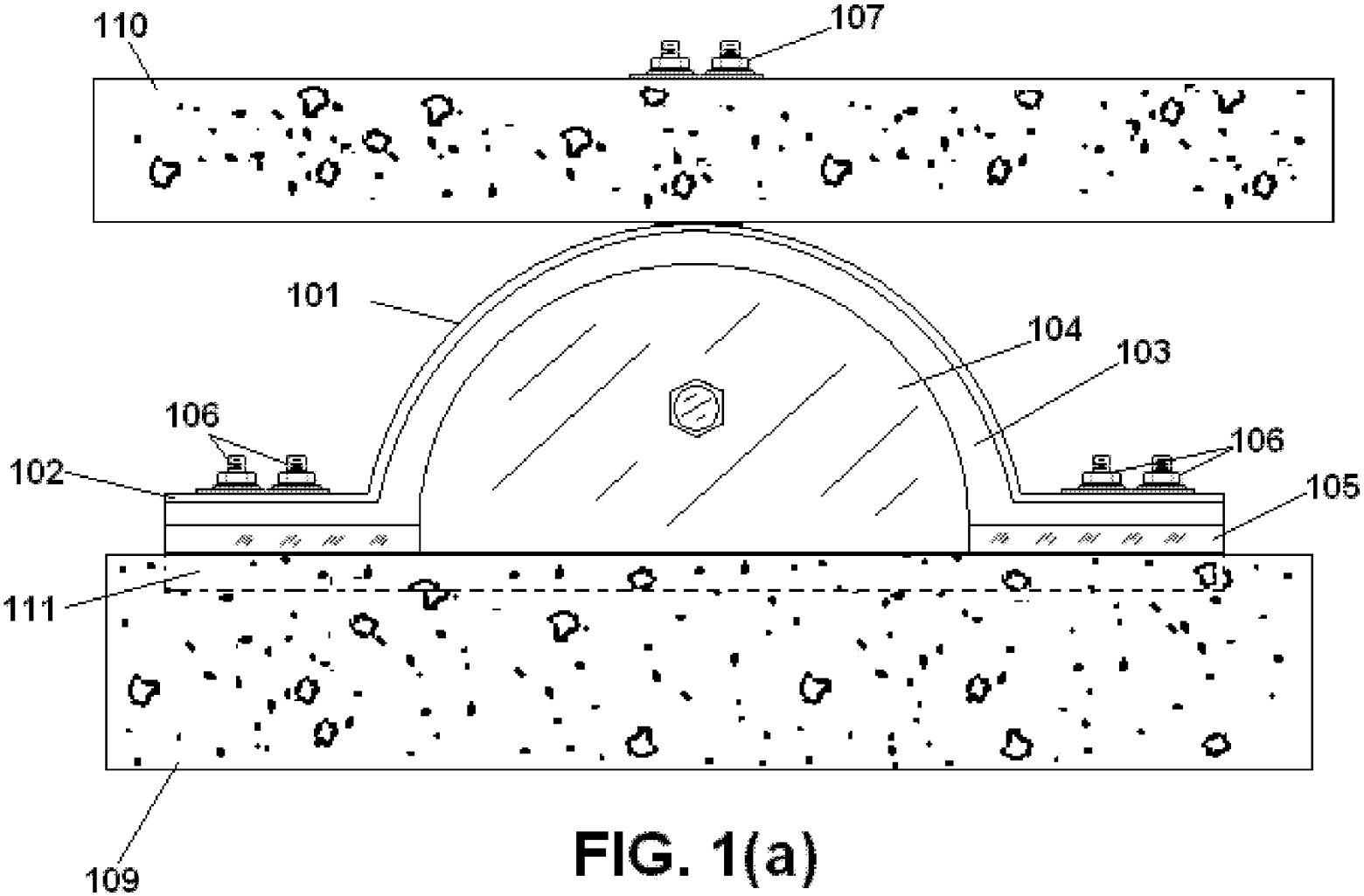
FIG. 1(*a*) is a front view of an energy absorbing apparatus installed within a structure, for example between the floor and foundation of a building, in accordance with one embodiment of the present invention.
Figure 1C:
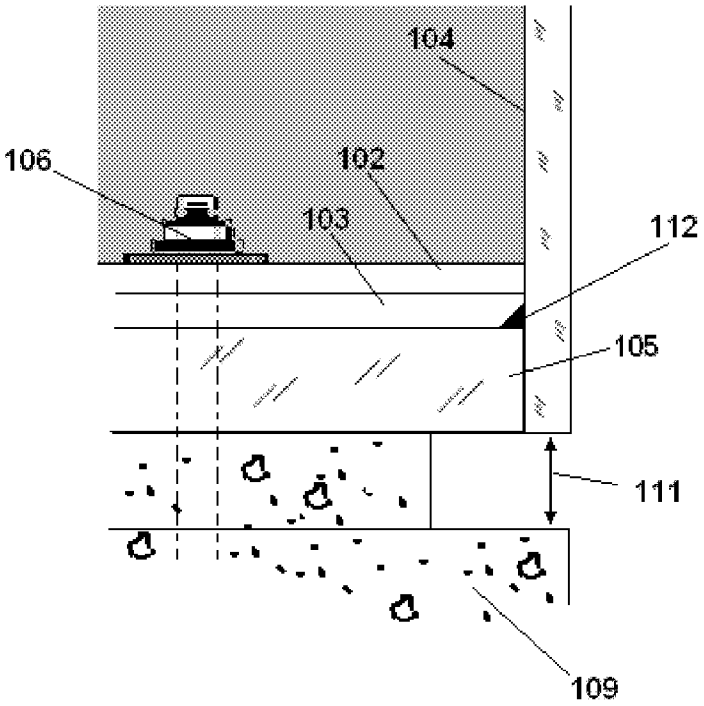
Figure 1B:
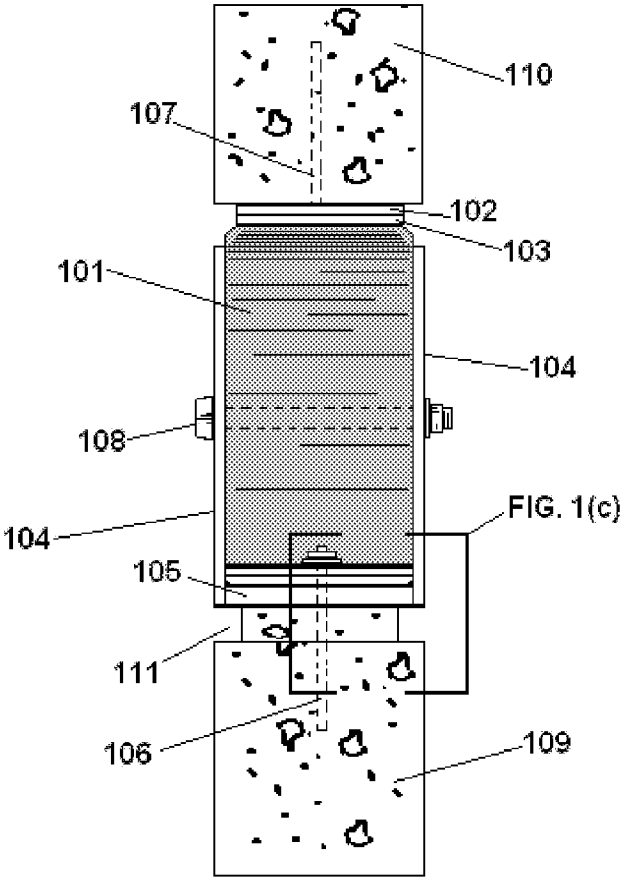
Figure 1D:
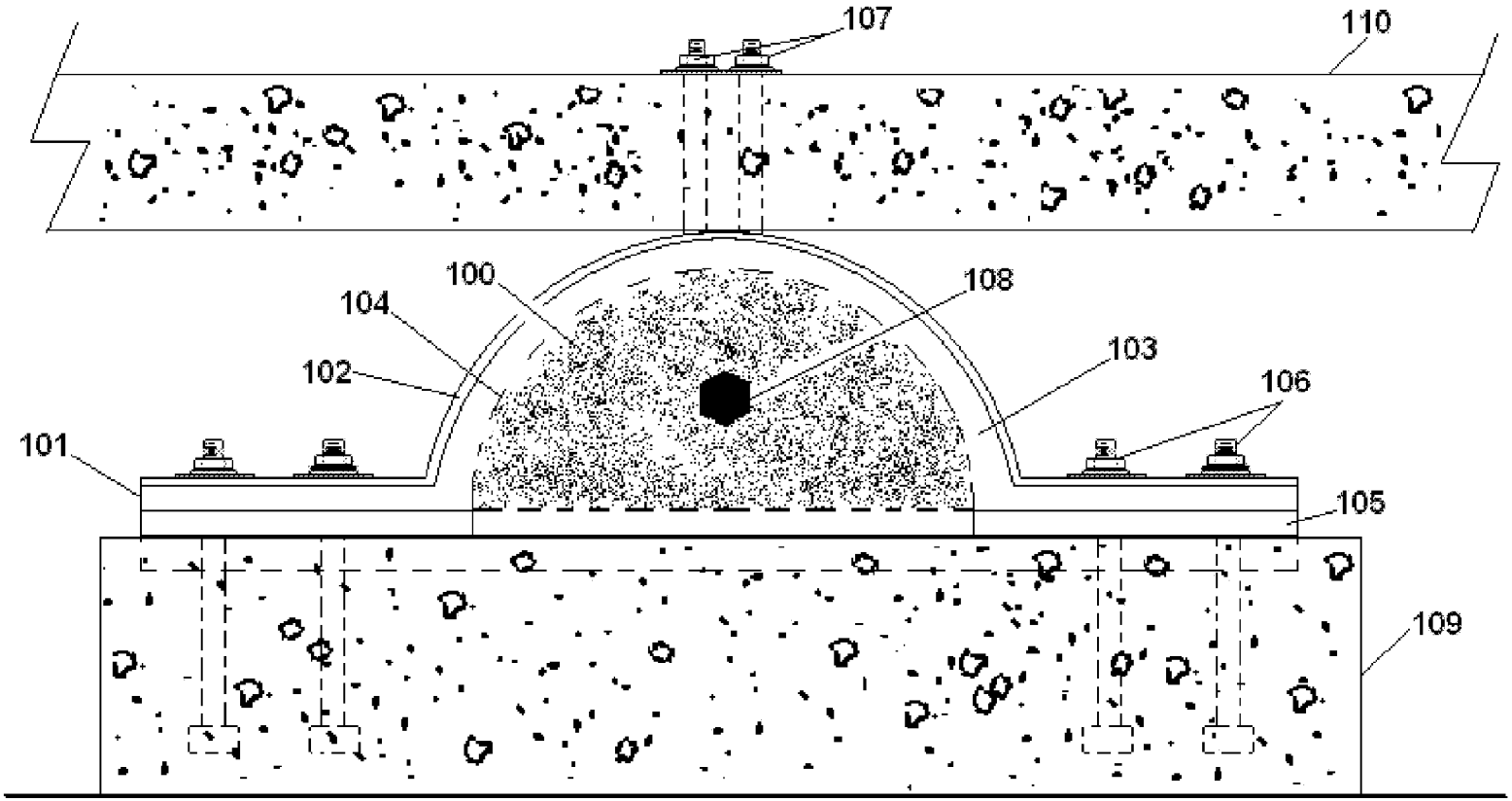

In the following discussion that addresses a number of embodiments and applications of the present invention, reference is made to the accompanying drawings that form a part hereof, and in which is shown by way of illustration specific embodiments in which the invention may be practiced. It is to be understood that other embodiments may be utilized and changes may be made without departing from the scope of the present invention.

FIG. 1(*a*)-FIG. 1(*d*) illustrate an energy absorbing apparatus installed within a structure, for example between the floor and foundation of a building, in one embodiment of the present invention.

FIG. 1(*a*) is a front view of an energy absorbing apparatus installed within a structure; FIG. 1(*b*) is a side view thereof, further illustrating one alternative installation feature which makes use of spacing 111 to minimize stiffness to the apparatus perpendicular to the direction of loading; FIG. 1(*c*) is a close-up view of a lower right portion of the energy absorbing apparatus illustrated in FIG. 1(*b*), depicting an exemplary way to assemble the various components thereof, and a more detailed illustration of a desired notch or spacing 111 to add flexibility and decrease stiffness, between the base of the apparatus and a support member of a structure; and FIG. 1(*d*) is a cross-sectional view thereof, illustrating the internal composition of an energy absorbing apparatus in accordance with the present invention.

The energy absorbing apparatus illustrated in FIGS. 1(*a*)-1(*d*) comprises of an energy absorbing material 100 (FIG. 1(*d*) only), a cover component 101, layer 102, layer 103, side plates 104, base 105, multiple bolts 106, multiple bolts 107, and a center bolt 108. In the illustrated embodiment, the apparatus is coupled or attached to a structural component 109, and a structural component 110. These individual components and their possible variations will be discussed in turn.

Energy absorbing material 100 may be any type of energy absorbing material such as filler made of granular elements, for example sand, crushed rocks, specially shaped rocks, or liquid substances, without departing from the scope of the present invention.

In one embodiment, energy absorbing material 100 is made from a granular fill that provides friction in concert with cover component 101 and its layers 102 and 103. This friction produces a desired dampening to reduce the vibrations caused by disruptive forces, for example, seismic forces or the force of an explosion.

In another embodiment, energy absorbing material 100 comprises a liquid mixture (which may further comprise other components such as oil without deviating from the scope of the present invention). In such embodiment, cover component 101 may further comprise of a spring-loaded chamber (not illustrated), without departing from the scope of the present invention. A chamber spring (not illustrated) may be utilized to push back any displaced liquid, displaced by a disruptive force, back into the cavity where energy absorbing material 100 (e.g. a liquid or oil mixture) is contained during a resting state of the energy absorbing device.

Cover component 101 envelopes or contains energy absorbing material 100 by creating a cavity between cover component 101 and base 105. Cover component 101 is illustrated comprising of multiple layers (i.e. layer 102, and layer 103) however, cover component 101 may be constructed of a single layer, two layers, or multiple layers, without deviating from the scope of the present invention.

In an exemplary embodiment, cover component 101 comprises of multiple layers 102 and 103, wherein one layer comprises of a rigid material and the other layer comprises of a resilient material, for example, and without deviating from the scope of the present invention, a resilient material such as rubber and a rigid material such as steel, may be embedded within cover component 101 for additional strength. Furthermore, a layer of a rigid material, for example steel, can be folded to release at a specific force level, a feature that may be desirable for some applications of an energy absorbing apparatus in accordance with the present invention.

Cover component 101 may be constructed of one material, a mixture of materials, or may be constructed of multiple layers of different materials bounded, or bonded, together to form cover component 101. For example, cover component 101 may be constructed of rubber or neoprene materials, or a mixture of both, without deviating from the scope of the present invention.

In an exemplary embodiment, cover component 101 comprises of a rigid layer and a resilient layer, (i.e. layers 102 and 103), wherein each layer is further reinforced with an additional material (e.g. nylon). For example, and without limiting the scope of the present invention, layer 102 comprises of steel sheet and nylon reinforcements and layer 103 comprises of rubber; the sheet steel and nylon being bonded to the rubber layer to form cover component 101.

Layers 102 and 103 may be bonded in any configuration; each layer of different materials may be bonded on the sides surrounding the rubber material, on top of the rubber material, or in any configuration, to bond the steel, nylon and rubber that comprise cover component 101. Furthermore, the thickness of layers 102 and 103 may vary depending on their respective materials. For example, and without deviating from the scope of the present invention, the thickness of steel and nylon reinforcements will vary to provide different material properties depending on the intended application (i.e. building reinforcements, military structures, or implementing an energy absorbing system for special cargo).

Cover component 101 is typically semicircular in shape (as illustrated); this shape is desired because of its strength and flexibility properties, however, cover component 101 may be shaped in a variety of forms—depending on the intended application for such energy absorbing device—without deviating from the scope of the present invention.

In one embodiment cover component 101 is triangular in shape; in another embodiment cover component 101 is circular in shape; in yet another embodiment cover component 101 is shaped like a square (with flat surfaces creating the cavity which houses energy absorbing material 100); Finally, in an embodiment utilizing a resilient component such as a rubber material, the rubber itself may be rectangular, u-shaped, or box-shaped.

In each of the aforementioned embodiments, layers 102 and 103 of cover component 101 may vary in specification (dimensions, weight, thickness, flexibility, etc.) depending on the material properties required to resist a desired magnitude of force—the thickness of steel and nylon reinforcement for example, may vary, depending on the desired material properties necessary to properly restrain displacement of cover component 101. Naturally, such properties will relate to parameter dependent factors, such as stiffness, damping ratio, or bearing displacement desired for a particular application of the present invention; such measurements and dimensions may be easily calculated with known methods and formulas—formulas and calculations that are presently well known to one skilled in the art.

Cover component 101 (as illustrated) is configured to create a cavity wherein said energy absorbing material 100 is contained. Thus, side plates 104 are desirable to enclose the cavity retaining energy absorbing material 100, although in an alternative embodiment, side plates 104 may not be necessary—for example an embodiment of the present invention wherein cover component 101 comprises of a box-shaped rubber component.

In an exemplary embodiment, side plates 104 are connected to cover component 101 with special bonding agents known in the art. Side plates 104 are ideally made of steel although other known materials may be utilized.

Center bolt 108 is perpendicular to and positioned between side plates 104, running through the cavity containing energy material 100. Thus, the rigidity and displacement capability of energy absorbing material 100 may be adjusted by tightening or loosening center bolt 108; as center bolt 108 is tightened, for example, side plates 104 are brought closer to create a smaller cavity, which is desirable to control the dampening capabilities of the energy absorbing device. Center bolt 108, along with bolts 106 and 107, help to transfer tension and shear forces away from the structure. Center bolt 108 may be a typical bolt, a clamping device or any other type of device known in the art that can be utilized to connect side plates 104. Typically, and perhaps more desirable, center bolt 108 is a typical bolt that is inexpensive yet made of durable strong material.

Cover component 101, and (if embodied), side plates 104, are configured to connect with a base 105 which also helps to transfer forces into the foundation and away from the remainder of the structure. While cover component 101 may be manufactured or molded or constructed in such manner as to create a cavity suitable for containment of energy absorbing material 100, cover component 101 may also be configured to rest or be connected with base 105 in such a matter so that base 105 completes the desired enclosure or cavity in which energy absorbing material 100 will be contained, without deviating from the scope of the present invention.

In an exemplary embodiment, cover component 101 comprises of layers 102 and 103, which have respective ends configured to attach to base 105 with multiple bolts 106.

Multiple bolts 106 need not be limited to more than one bolt, and multiple bolts are not the only method of connecting cover component 101 to base 105; any other known method may be utilized without deviating from the scope of the present invention. For example, bonding agents may be utilized, or clamp devices may be utilized which can be adjustable depending on the desired settings of the device. Typically, multiple bolts 106 are regular adjustable bolts that can be mounted on a structure to connect cover component 101 and base 105 to a structural component of some structure, such as structure component 109, and may be more desirable than a clamp device because of practical and economical considerations.

Similarly, multiple bolts 107 may also be utilized to connect cover component 101, to a structural component 110. Multiple bolts 107 may alternatively comprise a single bolt, a clamping device, or some type of bonding agent capable of securely connecting cover component 101 to a structure, but again, multiple bolts 107 may be more desirable than a clamp device because of practical and economical reasons; furthermore, a bonding agent may not be as effective as transferring forces away from the structure.

Structural components 109 and 110 may be any parts or components of a structure where an energy absorbing device may be mounted such as a frame or a support member. For example, and without deviating from the scope of the present invention, structural component 109 may be the foundation of a building and structural component 110 may be a frame or floor of said building.

In one embodiment, structural components 109 and 110 are building components, such as a foundation and floor frame, respectively, of a family home; in another embodiment, structural components 109 and 110 are components of a water barrier or levee; in yet another embodiment, structural components 109 and 110 are components of a fortified wall; and in yet another embodiment, structural components 109 and 110 are support members of a safety delivery or transportation device capable of protecting sensitive cargo.

FIG. 1(*b*) is a side view of an energy absorbing apparatus installed within a structure, for example between the floor and foundation of a building, illustrating how side plates 104 sandwich or contain cover component 101. In this perspective, layers 102 and 103 of cover component 101 are also visible at the top and bottom of the energy absorbing apparatus, where cover component 101 is coupled or attached to the structure with multiple bolts 107 and 106, respectively. Furthermore, one alternative installation feature which makes use of a spacing 111 to minimize stiffness to the apparatus perpendicular to the direction of loading is illustrated in this view. This spacing allows for movement to occur when a disruptive force is applied to an energy absorbing apparatus in a direction parallel to center bolt 108. How a structure is affected to such disruptive forces is further disclose in reference to FIG. 4(*a*) and FIG. 4(*b*), disclosing different installation configurations for energy absorbing apparatuses in accordance with the present invention.

FIG. 1(*c*) is a close-up view of a lower right portion of the energy absorbing apparatus illustrated in FIG. 1(*b*), depicting an exemplary way to assemble the various components of one embodiment of an energy absorbing apparatus, and a close-up of a desired notch or spacing 111 to add flexibility and decrease stiffness, between base 105 and a support member of a structure, for example structural component 109.

Spacing 111 is an alternative to various methods of achieving the desired flexibility. Typically, the stiffness of the energy absorbing apparatus, perpendicular to the direction of the loading, is minimal. In other words, a force applied in a direction perpendicular to side plate 104, for example, may cause side plate 104 to move sideways; in such event, spacing 111, as illustrated in FIG. 1(*c*), will allow for this movement to occur smoothly, thus transferring forces away from the structure and deviating stress from base 105 and side plates 104. Similarly, such spacing may be desirable at the top of the device where layers 102 and 103 make contact.

Nevertheless, spacing 111 is merely an alternative feature and other known methods of providing such flexibility may be employed without deviating from the scope of the present invention, for example, other resilient materials with a flexible property may be used in place of spacing 111; alternatively, spacing 111 may not be utilized at all but the stiffness or lack thereof of an energy absorbing apparatus may be accomplished simply by a particular composition of flexible materials used in the device's construction. Thus, spacing 111 may or may not be implemented without deviating from the scope of the present invention.

For example, whether spacing 111 is utilized in the apparatus's installation or not, the stiffness, flexibility or desired characteristics of the device may be altered depending on the manner in which the various components are coupled, attached, or bonded together.

FIG. 1(*c*) shows a typical way of bonding side plates 104 to base 105. In one embodiment, some bonding method or bonding component 112 may be applied to both base 105 and side plates 104, such as spot welding, to ensure a strong link between the two components allowing the device to resist a disruptive force from breaking off side plates 104. In another embodiment, a weaker bond may be used as bonding component 112 to allow side plates 104 to break off easily, transferring a disruptive force away from the structure. Thus, depending on the desired application, various types of bonding methods and materials may be used, or different installation configurations may be employed to provide a particular range of motion, flexibility or level of stiffness, for an energy absorbing device in accordance with the present invention.

An energy absorbing device in accordance with the present invention may thus be utilized in a number of different applications and embodied in many different uses. Similarly, its individual components may vary in shape, material type, and arrangement without deviating from the scope of the present invention. For example, and without limiting the scope of the present invention, FIG. 2(*a*) and FIG. 2(*b*) provide a more detailed example of an embodiment which comprises of various components that make up a device in accordance with the present disclosure.

Figure 2B:
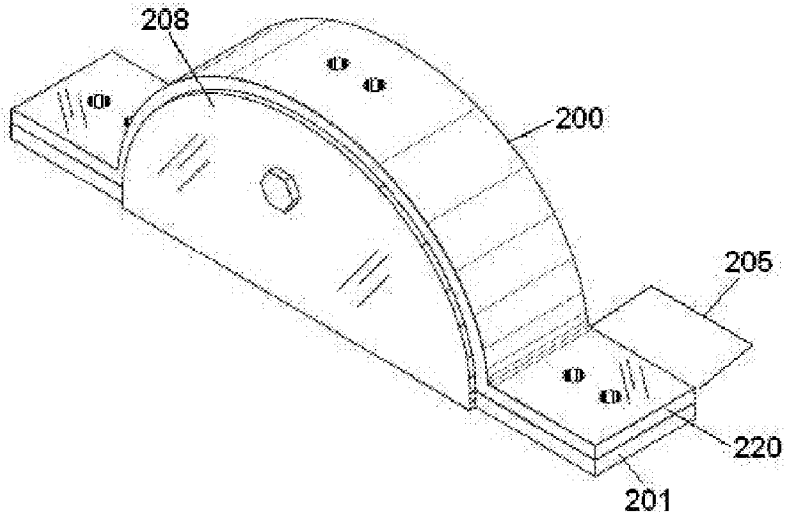
FIG. 2(*a*) is an exploded view of an energy absorbing apparatus, displaying its various components and parts, in another embodiment of the present invention.
Figure 2A:
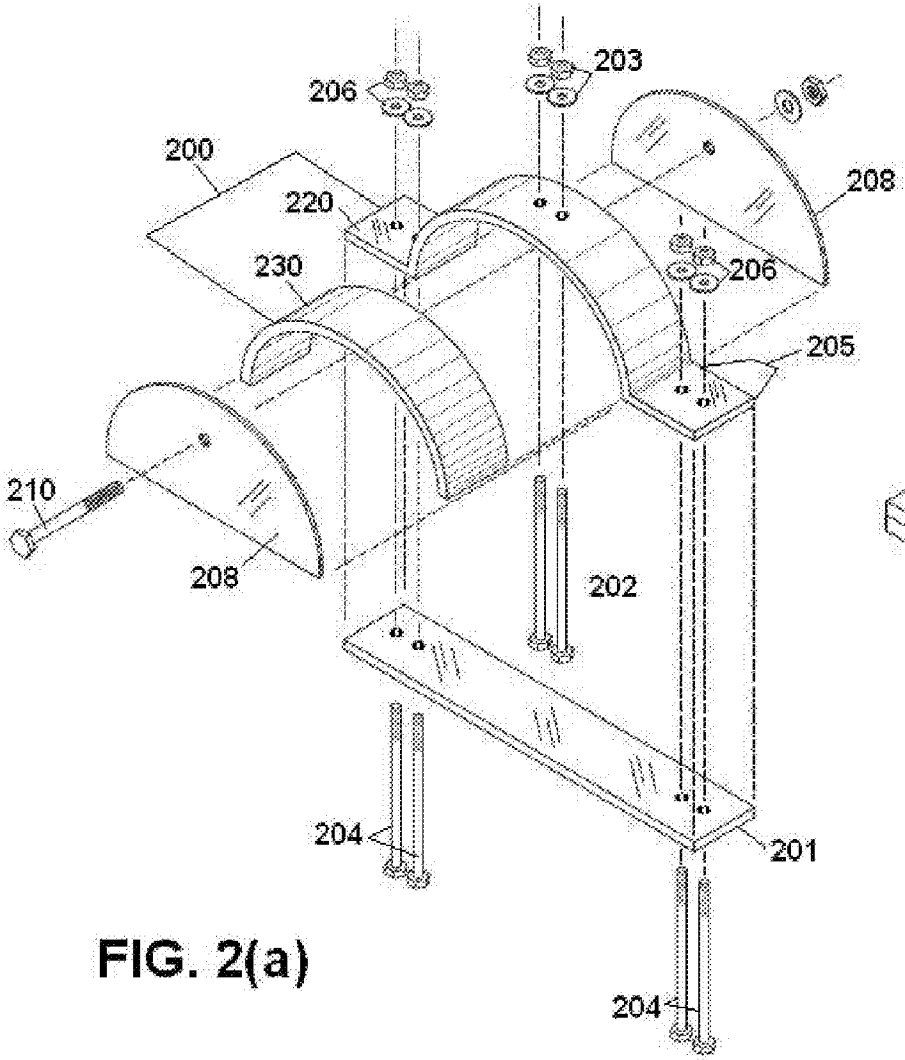

FIG. 2(*a*) is an exploded view of an energy absorbing apparatus, displaying its various components and parts, and FIG. 2(*b*) is an elevated plane view of the same, fully-assembled, energy absorbing device in accordance with another exemplary embodiment of the present invention.

In the embodiment illustrated in FIG. 2(*a*)-(*b*), cover component 200 comprises of layers 220 and 230. Typically, layer 220 is a rigid material, for example sheet steel, and may be a single layer or multiple layers bonded to layer 230, typically a resilient material such as rubber. However, as previously mentioned, layers 220 and 230 may be bonded or coupled in different configurations and may comprise different materials. Nevertheless, a rigid material against a resilient material do add a desired force which helps limit the displacement of the device and thus such configuration of components, that achieves a desired limited displacement, may be preferred to other configurations.

Cover component 200 is shown here with side reinforcements, or respective ends 205, which allow for cover component 200 to be coupled with base 201 and structural component 209 by connecting each component with typical bolts 204 and typical fasteners 206. Similarly, typical bolts 202 and fasteners 203 are utilized to connect cover 200 to a structural component 211. The cavity created between cover component 200 and base 201 can be filled with any type of material that has an energy absorbing property (as discussed above) such as a granular fill, a liquid, an oil based mixture, crushed sand, or any other type of energy absorbing material that may be displaced upon impact or subjection to a disruptive force.

To fully envelope the cavity between cover component 200 and base 201, side plates 208 are connected to both cover component 200 and base 201; as explained above, this coupling may be performed by utilizing a bonding agent, welding or any other type of method known in the art. Here, bolt 210 is utilized to connect side plates 208, sandwiching cover component 200 and creating a frictional force against the energy absorbing material (not shown) inside the cavity formed thereof. Again, as explained above, bolt 208 may be adjusted to create the right friction for the desired dampening effect of the device.

Figure 3:
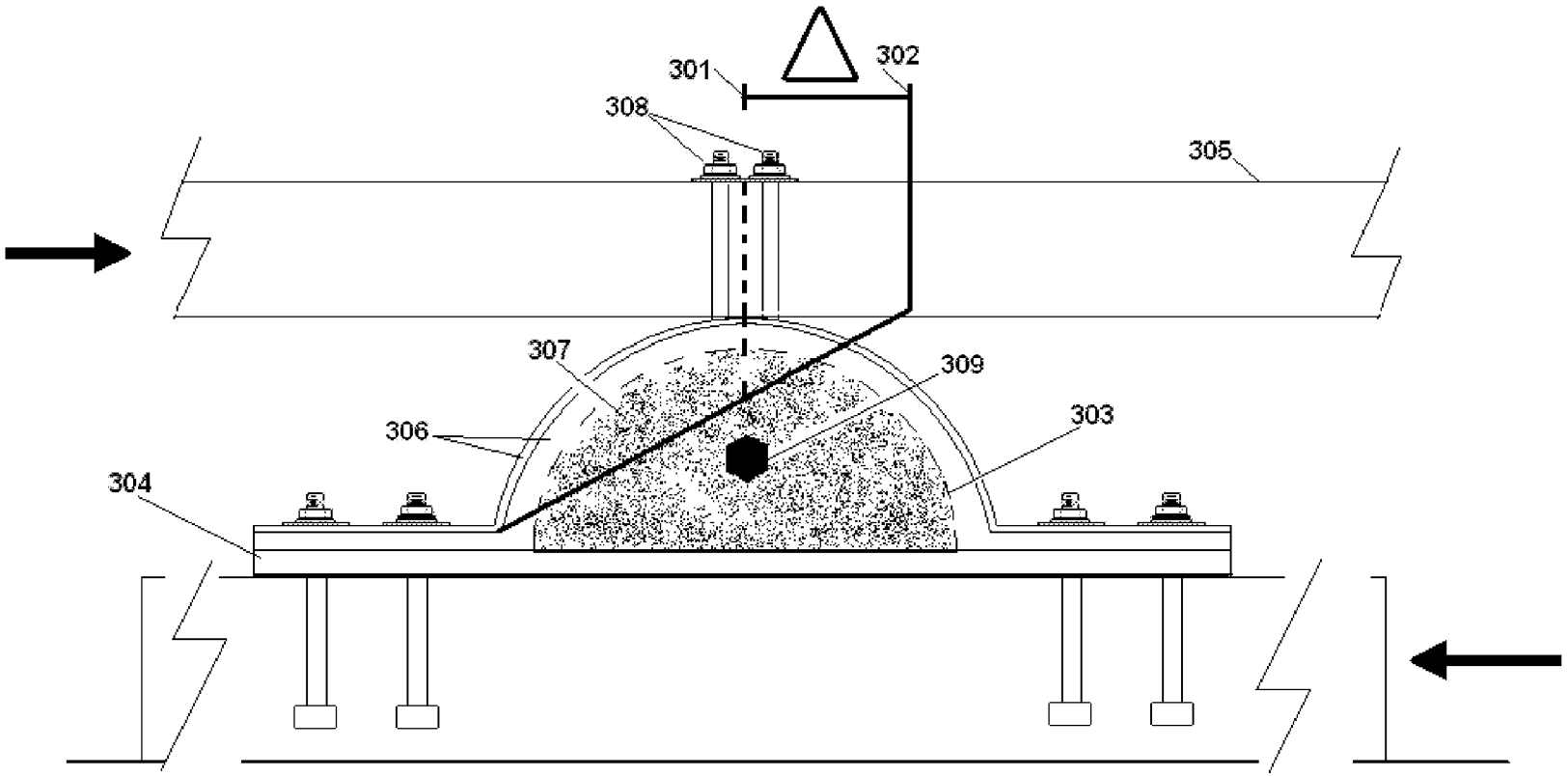
FIG. 3 illustrates the directional displacement which may occur, in one embodiment of the present invention, when a disruptive force is applied, for example seismic forces generated during an earthquake.

Having disclosed the various components of an exemplary embodiment of the present invention, we now turn to FIG. 3 for an illustration of the workings of a typical energy absorbing apparatus as described thus far.

In particular, FIG. 3 displays a directional displacement of one embodiment of the present invention, when disruptive forces are applied, for example seismic forces.

As the illustration shows, the energy absorbing device provides a load path between the ground and the structure. A disruptive force, such as an impact force, an explosive force, or a seismic force, causes the apparatus to displace, moving from point 301 to point 302 and creating a displacement.

The displacement is directional in that displacement is parallel to the side plates 303 of the apparatus. Therefore, if the ground moves horizontal, parallel to side plates 303, base plate 304 moves with the ground while the base member 305, (e.g. a superstructure) stays still or moves in an opposite direction enough to absorb the disruptive force. This movement, or displacement, causes the cover component 306 to displace, since it is flexible in nature. Inside, the energy absorbing material 307, for example a granular material, will also be displaced.

It is this displacement property that allows the ground to move independent from the structure. For example, and without limiting the scope of the present invention, when an energy absorbing apparatus, in accord with the present invention, is connected to the foundation of a structure, the superstructure (that is, the structure built above the foundation) will move independently from the foundation of the structure due to the displacement of the energy absorbing device.

Another feature that helps reduce damage to such structure, for example a building, is the dampening properties of the energy absorbing device. The dampening properties are created by the friction between the rubber of cover component 306, side plates 303, and energy absorbing material 307; as friction is created, the device absorbs the energy from the disruptive force.

The limitations come from the materials as far as displacement and dampening capabilities, and these thresholds and specifications can be calculated with known methods.

Other limitations include the following: the rubber is limited in displacement by the steel sheet—the steel sheet will displace until some limit, at which point the components will simply restrain movement. Obviously this is desired to prevent the collapse of a structure and maintain structural integrity. Again, these limitations can be calculated with known methods in the art.

Typically, under static conditions, the weight of the structure is carried by the sheet steel and rubber components that make up the energy absorbing apparatus, including the filler material. Under displacement, the filler material will still support the vertical load of the structure. Finally, the elastic properties of the components (i.e. rubber, steel sheets, and filler material) will restore the apparatus to its initial shape.

Figure 4B:
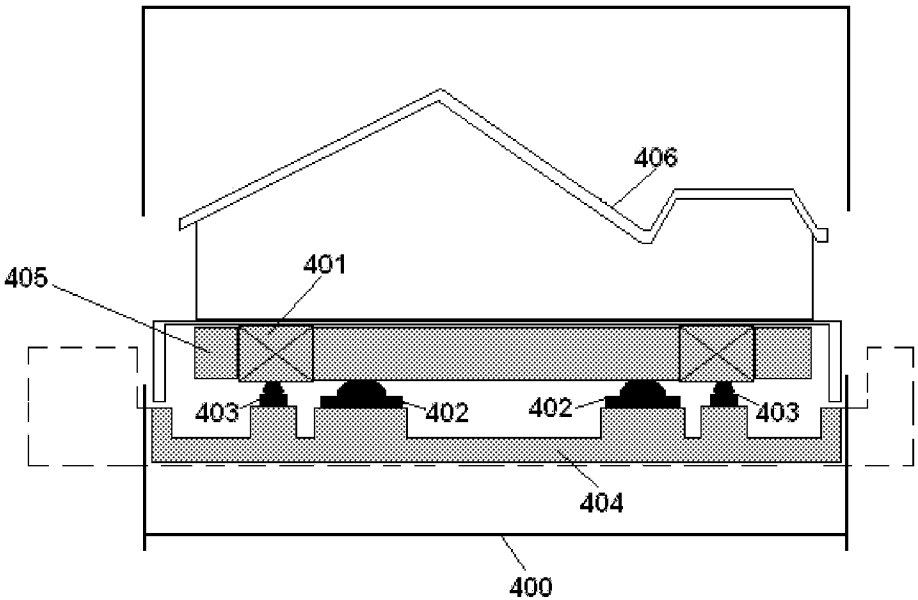
FIG. 4(*a*) is a diagram illustrating one possible configuration for installing several energy absorbing devices, in accordance to one embodiment of the present invention.
Figure 4A:
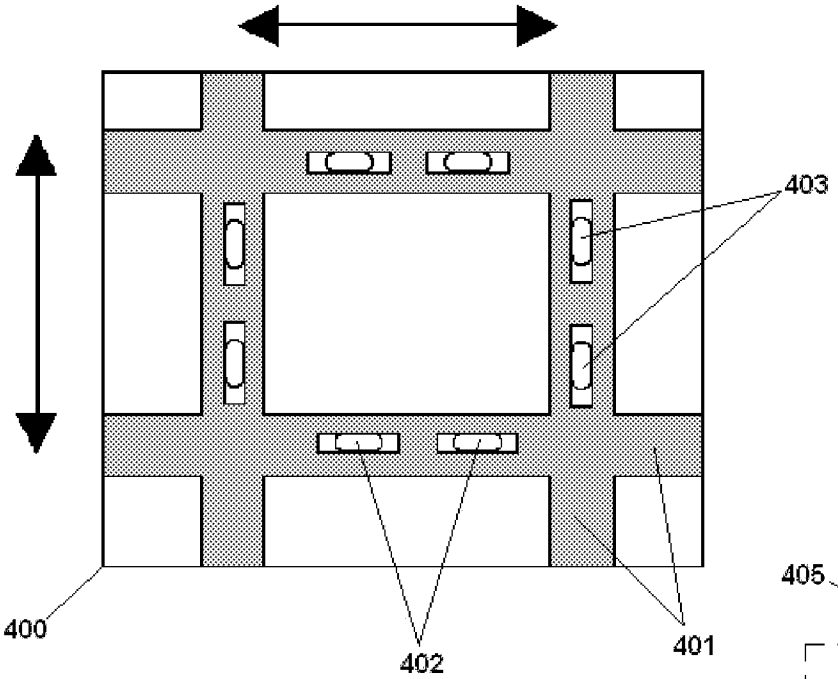

Turning next to FIG. 4(*a*), a diagram showing one possible configuration for installing several energy absorbing devices, in accordance to one embodiment of the present invention, is illustrated. The diagram is representative of a top view for a floor plan of a foundation for a structure such as a small home.

Grid section 401 is representative of structure support members, such as a frame or support beams attached to a small family dwelling, which are connected to the structure 400's foundation by resting on various energy absorbing devices, such as devices 402 and devices 403.

Devices 402 are oriented along the width of structure, for example, and devices 403 are oriented along the length of the structure as shown. This configuration is desirable so that superstructure 406 (see FIG. 4(*b*)) may withstand disruptive forces applied from a variety of directions, such as back and forth movements along the length of structure 400 or back and for the movements along the width of the structure 400.

For example, and without limiting the scope of the present invention, a force applied along the width of structure 400 (i.e. parallel to devices 402) will activate devices 402 and not activate devices 403. Similarly, a force applied along the length of structure 400 (i.e. parallel to devices 403) will activate devices 403 and not activate devices 402. Naturally, a force that comes from an angle neither perpendicular nor parallel with respect to either set of devices, 402 or 403, will activate both sets of devices 402 and 403 proportionally, depending on the direction of the disruptive force.

The non-activated devices, during a particular event when a disruptive force is applied to structure 400, may comprise of a flexible characteristic or feature that allow for transfer of forces during a non-activation stage of the device. For example, as mentioned above, spacing 111 (see, FIGS. 1(*b*) and 1(*c*)) or similar methods that decrease stiffness or increase flexibility perpendicular to the direction of the displacement load, come into play when devices 403 are activated but devices 402 are not. This feature helps balance out the unidirectional limitation of the device which is otherwise desirable to allow for much easier mathematical modeling predictions that make structural engineering an easier, more efficient task for those skilled in the art.

Finally, turning to FIG. 4(*b*), a diagram of a different view of the typical installation configuration illustrated by FIG. 4(*a*), which provides users with easy access to perform servicing or maintenance to such devices, for example, after an earthquake, is illustrated from a different perspective. Structure 400 is shown from a side view depicting the foundation 404, frame 405, and superstructure 406. In this simple diagram, it can be seen how a user, for example a home owner, or structural engineer, may access devices 402 and 403 for maintenance or repair, after a disruptive force, for example seismic forces from an earthquake, have been applied to structure 400. After an event such as an earthquake occurs, an engineer may reach a crawl-space between frame 405 and foundation 404 to inspect devices 402. Here, the engineer may determine whether devices 402 or devices 403 need to be replaced, fixed or adjusted.

A system and method for an energy absorbing system to safeguard structures from disruptive forces has been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching. It is intended that the scope of the invention not be limited by this detailed description, but by the claims and the equivalents to the claims.

What is claimed is:

1. An energy absorbing apparatus for protecting a superstructure from a disruptive force, comprising:

an enclosure with a variable rigidity, the enclosure including an adjustor for adjusting the rigidity of the enclosure, and a first connector for coupling the apparatus to an upper load-bearing member of the superstructure; wherein the enclosure further includes:

a layered region including a plurality of layers comprising:

a rigid layer, and a resilient layer that have a substantially semicircular cross-section, have substantially the same center, and have respective ends configured to attach to a base, wherein the rigid layer acts as a restraining material for the resilient layer when the disruptive force is applied to the enclosure; and wherein the base is coupled to the enclosure, the base including a second connector for coupling the apparatus to a lower load-bearing member of a lower structure.

2. The energy absorbing apparatus of claim 1, wherein the enclosure further includes: a non-layered region comprising an energy absorbing material, wherein the layered region is coupled to the base in a manner so as to form a cavity that substantially envelops the non-layered region.

3. The energy absorbing apparatus of claim 2, further comprising a plurality of side plates, wherein said resilient layer is securely sandwiched between said plurality of side plates to create a frictional force that is damping to said superstructure when said disruptive force occurs, and wherein the plurality of side plates are coupled to said base.

4. The energy absorbing apparatus of claim 3, wherein said enclosure is coupled to said upper-load bearing member of said superstructure near a top portion of said substantially semicircular cross-section.

5. The energy absorbing apparatus of claim 4, wherein opposite ends of the enclosure are coupled to said lower load-bearing member of said lower structure to provide a constant factor of initial and sliding friction between said rigid layer and said resilient layer for transferring tension and shear forces away from said superstructure.

6. The energy absorbing apparatus of claim 5, wherein said base is made of steel.

7. The energy absorbing apparatus of claim 5, wherein the enclosure further comprises a nylon layer.

8. The energy absorbing apparatus of claim 5, wherein said energy absorbing material further comprises a granular material, which provides vertical strength and allows for sideways slip when said disruptive force is applied.

9. The energy absorbing apparatus of claim 5, wherein said energy absorbing material further comprises a liquid, which provides vertical strength and allows for sideways slip when said disruptive force is applied.

10. The energy absorbing apparatus of claim 9, wherein the enclosure further comprises a valve to transfer said liquid into a spring loaded chamber of the enclosure whenever said disruptive force is applied, said spring loaded chamber having a spring positioned to push said liquid back into the enclosure whenever the enclosure is relieved from said disruptive force.

11. An energy absorbing system, comprising:

a lower-load bearing member of a lower structure;

an upper-load bearing member of a superstructure; and at least one energy absorbing apparatus, wherein said energy absorbing apparatus comprises:

an enclosure with a variable rigidity, the enclosure including an adjustor for adjusting the rigidity of the enclosure, and a first connector for coupling the apparatus to the upper load-bearing member of the superstructure wherein the enclosure further includes:

a layered region including a plurality of layers comprising:

a rigid layer, and a resilient layer, that have a substantially semicircular cross-section, have substantially the same center, and have respective ends configured to attach to a base, wherein the rigid layer acts as a restraining material for the resilient layer when the disruptive force is applied to the enclosure; and wherein the base is coupled to the enclosure, the base including a second connector for coupling the apparatus to the lower load-bearing member of the lower structure.

12. The system of claim 11, wherein the enclosure further includes: a non-layered region comprising an energy absorbing material, wherein the layered region is coupled to the base in a manner so as to form a cavity that substantially envelops the non-layered region.

13. The system of claim 11, further comprising a plurality of side plates, wherein said resilient layer is securely sandwiched between said plurality of side plates to create a frictional force that is damping to said superstructure when said disruptive force occurs, and wherein the plurality of side plates are coupled to said base.

14. The system of claim 13, wherein said enclosure is coupled to said upper-load bearing member of said superstructure near a top portion of said substantially semicircular cross-section.

15. The system of claim 12, wherein opposite ends of the enclosure are coupled to said lower load-bearing member of said lower structure to provide a constant factor of initial and sliding friction between said rigid layer and said resilient layer for transferring tension and shear forces away from said superstructure.

16. The system of claim 15, wherein said base is made of steel.

17. The system of claim 15, wherein said energy absorbing material comprises a granular material, which provides vertical strength and allows for sideways slip when said disruptive force is applied.

18. An energy absorbing apparatus for protecting a superstructure from a disruptive force, comprising:

a base including a first connector for coupling the apparatus to a lower-load bearing member of a lower structure;

an enclosure with a variable rigidity coupled to the base in a manner to form a cavity, the enclosure comprising an adjustor for adjusting the rigidity of the enclosure, and a second connector for coupling the apparatus to an upper load-bearing member of said superstructure; wherein the enclosure further includes:

a layered region including a plurality of layers comprising:

a rigid layer and a resilient layer, that have a substantially semicircular cross-section, have substantially the same center, and have respective ends configured to attach to the base, wherein the rigid layer acts as a restraining material for the resilient layer when the disruptive force is applied to the enclosure; and an energy absorbing material within said cavity, the energy absorbing material including a granular material, which provides vertical strength and allows for sideways slip when said disruptive force is applied.

* * * * *